United States Patent [19]

Buys

[11] 4,212,215

[45] Jul. 15, 1980

[54] APPARATUS FOR CUTTING A TUBE OF SEMI-RIGID MATERIAL

[75] Inventor: Bruno Buys, La Madeleine, France

[73] Assignee: Astec, France

[21] Appl. No.: 921,179

[22] Filed: Jul. 3, 1978

[30] Foreign Application Priority Data

Jul. 6, 1977 [FR] France ..... 77 21393

[51] Int. Cl.[2] ..... B26D 3/16

[52] U.S. Cl. ..... 83/109; 83/411 A; 83/415; 83/466.1; 83/467 R

[58] Field of Search ..... 83/411 R, 411 A, 415, 83/454, 466.1, 467, 733, 109

[56] References Cited

U.S. PATENT DOCUMENTS

| | | | |
|---|---|---|---|
| 360,946 | 4/1887 | Beekman | 83/454 |
| 1,424,472 | 8/1922 | Goldberg | 83/411 R |
| 1,746,930 | 2/1930 | Clark | 83/411 R |
| 1,813,340 | 7/1931 | Conti | 83/411 R X |
| 2,810,438 | 10/1957 | Stone | 83/411 R |
| 3,253,333 | 5/1966 | Keiter | 83/411 R X |
| 3,291,168 | 12/1966 | Zitner | 83/411 R X |
| 4,055,100 | 10/1977 | Borzym | 83/454 |

*Primary Examiner*—Frank T. Yost

*Attorney, Agent, or Firm*—Robert E. Burns; Emmanuel J. Lobato; Bruce L. Adams

[57] ABSTRACT

Apparatus for cutting a tube of semi-rigid material at a predetermined point to make possible separate removal of the contents of the tube on either side of the cutting point comprises a flat blade and jaws which together define a longitudinal channel suitable for receiving and gripping the tube for the greater part of its periphery. The jaws are provided with a slit which intersects the channel transversely over the whole of its cross-sectional periphery. Additionally means for relatively moving the blade and jaws are provided so that the blade penetrates the slit and its cutting edge passes transversely through the channel, thus cutting the tube, until the blade covers the section of the channel level with the slit, and provides a seal to both parts of the tube after cutting.

13 Claims, 3 Drawing Figures

APPARATUS FOR CUTTING A TUBE OF SEMI-RIGID MATERIAL

FIELD OF INVENTION

The present invention relates to apparatus for cutting a tube made from semi-rigid material.

More precisely the apparatus according to the invention is intended to cut transversely a longitudinal tube at a pre-determined point so as to separate two phases of material in the tube.

BACKGROUND OF THE INVENTION

Such apparatus can be particularly but not exclusively used in connection with tubular centrifuging techniques where a tube is cut transversely at a point corresponding to the point of contact between phases separated by centrifuging and in order to recover these phases separately.

These phases may be liquid or solid.

At the present time use is made for this purpose of a thin cutting blade, such as a razor blade, which in use is held in one hand and used to cut a tube, which is held in the other hand. As the diameter of the tube is usually small, generally of the order of a few millimetres, the phases contained respectively in the two length of tubing are retained therein by capillary action.

This method has the disadvantages that the cut is not clean, involving a risk of leakage, and, owing to the distortion of the tube by the application of the blade, a risk of the phases which have been separated getting mixed together again, or at least of the passage of one of the phases beyond the point of cutting.

SUMMARY OF THE INVENTION

The object of the present invention is to overcome or substantially mitigate these disadvantages and provide a cutting apparatus which, on the one hand, imposes on both the blade and the tube a strict and precise positioning in relation to each other at each moment of cutting, and thereafter, ensures as clean a cut as possible, thus also allowing the blade to act afterwards as a seal between the two separated lengths of the tube, and which, on the other hand, ensures on either side of the cutting point, that the periphery of the tube is not distorted by the penetration of the blade, and thus avoids any disturbances of the media to be separated.

According to the present invention there is provided apparatus for cutting a tube of semi-rigid material at a pre-determined point to make possible separate removal of the contents of the tube on either side of the cutting point, and comprising:

a flat blade provided with a cutting edge and a flat portion the dimensions of the latter being at least equal to the cross-sectional dimensions of a tube to be cut at the desired cutting point;

jaws which together define a longitudinal channel with a transverse profile complementary to that of the tube to be cut so that they can receive the latter inside them, the said jaws also defining in an area adjacent to the channel, a slot running transversely in relation to the general direction of the channel and intersecting the latter transversely across and through the whole of its transverse periphery at a level corresponding with the level at which it is desired to cut a tube when fixed in the channel;

Means for clenching the jaws around a tube so as to grip it over the greater part of its periphery, at least in zones situated in the immediate proximity of the slot and on either side of the latter; and means for relatively moving the blade and the jaws whereby the blade enters the slot and its cutting edge passes transversely through the channel to cut a tube therein until the flat part of the blade completely covers the crosssection of the channel at the point of the slot, and seals off the two parts of the tube after cutting from each other.

BRIEF DESCRIPTION OF DRAWING

The present invention will now be described by way of example with reference to the accompanying drawings in which.

DESCRIPTION OF PREFERRED EMBODIMENT

Figure 1:
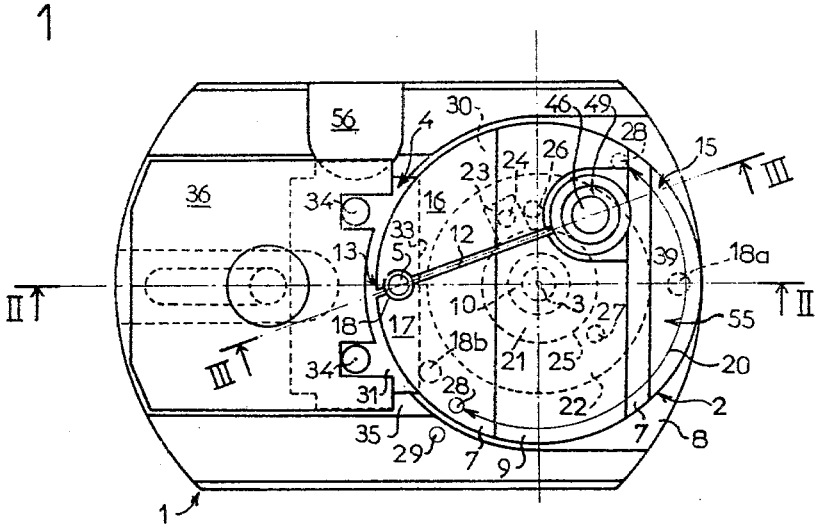
FIG. 1 is a plan view of apparatus in accordance with the invention, shown in a position in which a blade thereof is fully engaged in a cut tube and is sealing off the two cut parts of the latter.
Figure 2:
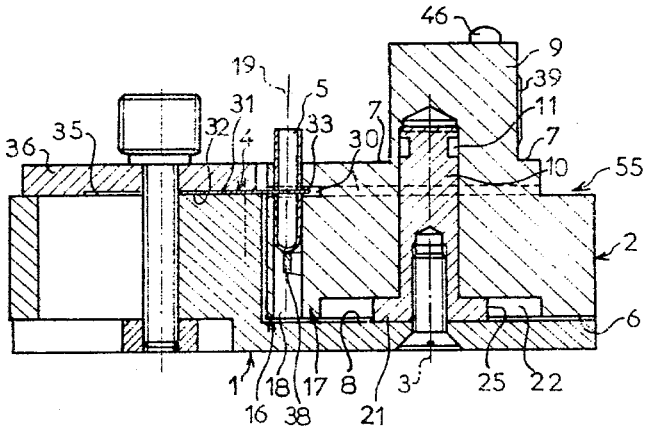
FIG. 2 is a sectional view along the line II—II in FIG. 1.

In the drawings, a base of the apparatus is indicated by numeral 1, a turret freely rotatably mounted on the base 1 round a vertical axis 3 by 2, a blade to carry out a cutting operation by 4 and a tube cut by means of the apparatus 5.

The turret 2 is substantially cylindrical in shape and can freely rotate about its longitudinal axis 3. The turret 3 has two flat transverse faces 6 and 7 forming its lower and upper surfaces respectively, the first face 6 sliding on a complementary horizontal face 8 of the base, and the other face 7 which is provided with a projection 9 forming a handle, facilitating the gripping of the turret 2 to cause it to rotate about the axis 3.

The turret 2 is mounted on a pivot 10 which is fixed to the base 1 above the face 8 of the latter and is provided with a cylindrical periphery centred around the axis 3. The pivot 10 engages in a blind whole with a mating profile in the turret 2, which is free to rotate round it, whilst any relative axial movement is prevented, for example, by means of a linchpin fixed to the turret 2 and sliding, whilst the latter is rotating round the pivot 10, in an annular groove 11 on the periphery of the latter.

To receive and hold a tube 5 in position, the turret 2 comprises two jaws 16 and 17 defined, along the full height of the turret 2, that is over its dimension parallel to the axis 3, by a slot 12. The slot 12 is substantially smooth with walls parallel to the said axis 3 and is positioned when viewed along a transverse plane relative to the axis 3, along a chord of the cylindrical periphery of the turret 2 but cutting this periphery only at one of its ends 13, its other end 14 falling short of the said cylindrical periphery, so that there is an area 15 of the turret 2 connecting the two jaws 16 and 17 together.

Adjacent to the end 13 of the slot 12, the two jaws 16 and 17 which it delimits present a profile such that they form respectively the two halves of a longitudinal channel 18 with a longitudinal axis 19 parallel to the axis 3.

This channel is intended to receive the tube 5 which is to be cut, which is assumed here to be cylindrical, and to hold it during and after a cutting operation.

For this purpose the channel 18 has transverse dimensions slightly in excess of the outside transverse dimensions of the tube 5 when the jaws are unclenched, and tends to assume transverse dimensions slightly below those of the tube 5 when the jaws are clenched together; the tube can thus be introduced without difficulty into the channel 18 with their longitudinal direction coinciding, when the jaws are unclenched but it is firmly held between the jaws when the latter are clenched.

The clenching and unclenching of the jaws is preferably carried out automatically during the rotation of the turret 2 around the axis 3, shown on FIG. 1 by arrow 20, over an angle of 180°, showing the position of the channel 18 and the tube 19 in ordinary continuous lines which position corresponds to their position at the end of a cutting operation and the position shown in dotted lines, at 18*a*, situated at 180° from the previous one, corresponding to the position where the tube 5 is either about to be inserted into the channel 18 or about to be extracted from the channel 18 after the cutting operation.

The pivot 10 is provided in the immediate vicinity of the face 8 of the base 1, to which it is fixed, with a cam 21, which is also fixed in relation to the base and which is eccentric in relation to the axis 3. This cam 21 is located in a cavity 22 provided for this purpose in the lower face 6 of the turret 2, which cavity 22 has dimensions in the transverse direction in relation to the axis 3 exceeding the largest corresponding dimensions of the cam 21.

The jaw 16 situated on the far side of the slot 12 from the axis 3, is provided in its turn at the bottom in the cavity 22, with a cam follower 23 attached thereto by means of a rivet 24. The cam follower 23 is applied to the eccentric periphery 25 of the cam 21 by virtue of the elasticity of the material from which the turret 2 is made and slides against this eccentric periphery 25 during the rotation of the turret, moving away from the axis 3 when the cam rotates in an anti-clockwise direction from the position shown by continuous lines in FIG. 1 to the position shown at 18*a* by dotted lines, and conversely approaching the axis 3 during clockwise rotation of the cam from the position shown at 18*a* to the position shown by continuous lines as at 18.

It is advantageous also for the cam follower 23 to act as a stop, fixing the two extreme positions of rotation, by coming into contact in these positions with studs 26 and 27 located on the upper face 8 of the base 1 and fixed in relation to the latter.

The two extreme positions of rotation may with advantage be delimited by the positioning of a reference stud 28 on the upper face 7 of the turret 2, adjacent to a corresponding stud 29 on the base 1 and at a position 180° away from this second stud 29 respectively.

In practice the gripping of the tube 5 between the jaws 16 and 17 must be effected before the blade 4 comes into contact with the tube to cut it.

To hold this blade 4, the turret 2 is provided with an annular groove 30 which has a depth, measured parallel to the axis 3, slightly exceeding that of the blade 4 to allow movement of the latter and the transverse cutting of the tube 5 fixed in the channel 18, whilst enabling the jaws 16 and 17 to have a firm grip around the maximum periphery of the tube 5 on either side of the blade 5 and as near as possible thereto.

To effect this, the groove 30 has a radial dimension such that its area of smallest diameter is situated beyond the channel 18 from the axis 3.

The blade 4 must be flat and as thin as possible; its cutting edge 33 must be as even as possible to allow of a smooth cut into the tube; its flat surfaces should be defined by two parallel faces 31 and 32, which, once the tube has been cut, come into contact respectively with the bottom of its upper section 5*a* and the top of its lower section 5*b* to seal them tightly, and make possible for example the removal by pipette of the contents of the upper section 5*a* without the contents of the lower section 5*b* being affected.

In the case of tubes 5 of plasctic material of a diameter less that 5 mm used in centrifuging techniques, for example, the blade 4 may with advantage take the form of a standard razor blade with a thickness of 0.1 mm, and made preferably of stainless material.

The blade 4 is firmly held on the base 1 in a transverse position in relation to the axis 3 and level with the annular groove 30, into which it is permanently extends; the cutting edge 33 of the blade is located in the annular groove 30 along a chord of the transverse section on the plane of the turret 2 at this level (see FIG. 1.).

The securement of the blade 4 may with advantage be carried out by two centring studs 34 which engage in the holes provided for this purpose in standard razor blades, the face 32 of the blade being in contact with a flat face 35 of the base, running perpendicular to the axis 3, and an upper plate 36 held on to the base 1 by being screwed and pressing against the other face of the blade 31.

The method of use of such an appliance is as follows:

After having made sure that the cutting edge of the blade is in good condition, the turret 2 is moved to the position for the insertion of the tube 5 into the channel 18, that is into a position where the reference stud 28 is diametrically opposite to the reference stud 29 and where the channel 18 is in position 18*a*.

The tube 5, to be cut, is then inserted longitudinally into the channel 18 until the bottom of this tube 37 comes into contact with a stop 38 inserted between the two jaws 16 and 17 at least in their areas corresponding to the channel 18.

The longitudinal level of the stop 38 in the channel 18 can be regulated to adjust the cutting point of the tube, i.e. to make the annular groove 30 of the turret 2 coincide with the transverse point on the tube where it is desired to cut the latter.

Figure 3:
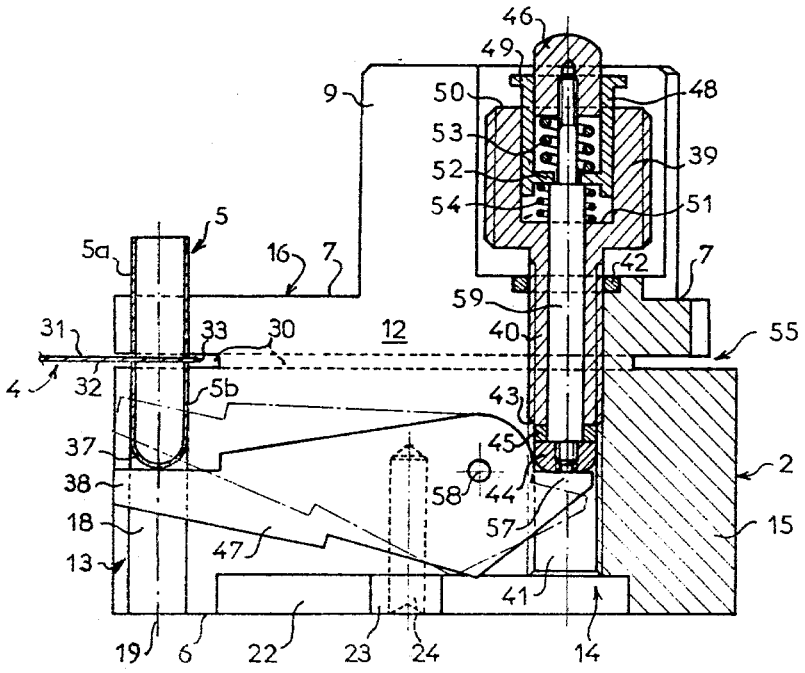
FIG. 3 is a sectional view of a turret along the line III—III of FIG. 1.

This adjustment, which can be followed visually through the end 13 of the slit 12, is carried out here by means of a milled knob 39 fitted to the projection 9 of the turret 2 (FIG. 3).

This milled knob 39 is fixed to a tubular rod 40; threaded on the outside, which can be screwed or unscrewed as desired by rotating the knob 39, in a vertical hole 41 drilled in the turret 2, which is threaded to mate with the rod; this hole 41 is situated in the immediate proximity of the second end 14 of the slit 12. An O-ring 42 inserted between the outside periphery of the tubular rod 40 and an annular groove in the turret situated at the top of the hole 41 offers slight resistance to the rotation of the rod 40 in the hole 41 and thus stabilizes the adjustments made.

The lower end 43 of the tubular rod 40 is supported at the bottom on an elastic ring 45, which in turn is supported at the bottom by a head 44, which applies a thrust on the end 57 of a lever 47 of which the other end forms the stop 38. This lever 47 can slide freely inside the slit, and is freely rotatably mounted between its two ends 57 and 38, around a transverse axis 58 in relation to the general plane of the slit 12, so that screwing of the milled knob 39 in one direction results in a downward movement of the head 44, which is accompanied by pivoting of the lever 47 and hence the raising of the stop 38 and of the tube 5 which it supports at the bottom in the channel 18. Conversely the screwing of the milled knob 39 in the opposite direction results in a downward movement of the stop 38 and tube 5 in the channel 18.

As will appear later, the lever 47 also serves for the ejection of the cut lengths of tube at the end of the operation.

After having thus adjusted the level of the tube 5 in the channel 18, the turret 2 is smoothly turned clockwise until it comes into contact with the stop at the end of its travel, with the two reference studs 28 and 29 coinciding.

During the course of this rotation, at first the jaws 16 and 17 grip the tube 5, then the latter comes into contact with the cutting edge 33 of the blade, moving tangentially in relation to the latter.

As is shown in FIG. 1, where the position of the channel 18 corresponding to this initial contat between the cutting edge 33 of the blade and the tube to be cut 5 is shown at **18*b*, the cutting movement of the blade, resulting from the rotation of the turret until the channel 18 occupies the position shown in continuous lines on the drawings, is accompanied by a movement of the cutting edge 33 tangentially in relation to the channel which makes it possible to cut right through the tube 5** with a minimum of effort.

As the rotation of the turret continues, the blade 4 penetrates the channel 18 further and further, and in the position shown at the end of the cutting operation where the reference studs 28 and 29 coincide with each other its cutting edge 33 has passed right through and beyond the channel 18. In this position, the top face 31 of the blade constitutes a leak-proof bottom to the upper length **5*a* of the tube 5, the contents of which can for example be emptied out by pipette, whilst the lower face 32 of the blade in its turn provides a tight seal for the lower length of the tube 5*b***.

The progressive penetration of the blade into the tube causes a separation of the two lengths **5*a* and 5*b* in the direction of the axis 19. In order that this separation will result in an equal longitudinal movement of the two parts and in order that a cut is obtained which is perpendicular to the general direction of the axis 19, the total surface of the jaws in contact with the wall of the tube 5 is equal both above and below respectively the groove 30. This can be achieved for example by flaring the channel 18** at the bottom; such flaring may be very minor in extent and therefore does not appear in the drawings.

The downward movement of the length **5*b* results in downward movement of the stop 38, through the squeezing of the elastic ring 45 inserted between the head 44 supported underneath on the end 46 of the lever 57 and the lower end 43** of the level adjustment assembly.

After having removed the contents of the upper length **5*a* from the tube, the turret 2 is rotated in the opposite direction to bring the reference studs 28 and 29 in diametrically opposite positions; the jaws are then automatically released and when the channel 18 occupies the position 18*a*, there is no difficulty in removing the lengths 5*a* and 5*b*** of the tube.

In the example shown, such removal is carried out by means of an ejecting device making it possible to eject successively the upper length **5*a* and the lower length 5*b***.

In the example illustrated, the ejection device is linked with the device involving the stop 38 for regulating the level, the stop 38 being provided with an upward movement to effect ejection.

Referring more particularly to FIG. 3, it will be seen that inside the tubular rod 40, there is provision for a rod 59 to slide vertically, having at its lower end a head 44 and at its upper end a push-button 46.

The push-button 46 is fitted to slide freely and vertically in a sleeve 48 which is in its turn fitted to slide freely and vertically inside the milled knob 39. The sleeve 48 has at the top a collar 49 projecting outwards and situated at rest at a distance from the upper surface 50 of the milled knob 39, this distance being equivalent, taking into account the reduction in ratio resulting from the lever 47, to the distance separating the annular groove 30 of the turret 2 from the upper face of the latter. The lower end 52 of this sleeve 48 is situated at a distance at least equal from the bottom 51 of the internal cavity of the milled knob 39, in which this sleeve moves.

The bottom of the push-button 46 is at a distance from the bottom 52 of the sleeve 48 equivalent, taking into account the reducing effect of the lever 47, to the maximum possible distance between the stop 38 and the annular groove 30 of the turret 2.

Between the push-button 46 and the bottom 52 of the sleeve 48 on the one hand and between this bottom 52 and the bottom 51 of the cavity in the milled knob 39 on the other hand, there are two springs, 53 and 54 respectively, which tend to maintain the maximum possible distance between these different parts. The spring 53 offers an elastic resistance to be downward movement of the push-button 46 exceeding that offered by the spring 54 to the downward movement of the sleeve 48.

Pressing the push-button 46 therefore first causes the sleeve 48 to move downwards inside the milled knob 39 until the collar 49 comes into contact with the surface 50 of the milled knob, and this movement has resultant effects on the level of the head 44 and the stop 38 of the lever 47, which causes the tube 5 inside the channel to rise so that the length **5*a* is entirely released from the channel; the corresponding position of the lever 47 is shown in dashed lines in FIG. 3. If the push-button 46 continues to be pressed, the button 46 slides downwards inside the sleeve 48 and presses against the milled knob 39, until the lower length 5*b* of the tube 5** is ejected.

It should be noted that it is possible, after having effected the first ejection, not to eject the lower length **5*b*, but to readjust the level of the stop 38 to cut this length 5*b*** again at any desired point, by resuming the operation described above.

The device just described may of course be subject to numerous variations without departing from the scope of the invention.

Such variations may have regard to the practical design of the various parts of the device, in particular the jaws 16 and 17 and the clenching and declenching of same.

In the construction described above, the elasticity of the material of which the turret 2 is made is used as a means of clenching the jaws 16 and 17. The turret can be made of various materials, preferably not subject to oxidisation, with the necessary elastic characteristics. In particular one for example polyformaldehyde resins, stainless steel, are suitable.

The shape of the channel 18 must of course be adapted to that of the tubes to be cut, in particular as regards their sectional shape, so that the tube is held firmly over its periphery on either side of the cutting area.

Furthermore, various accessory devices can be designed to facilitate the use of this device.

In particular a certain number of devices have been shown in the drawings to facilitate changing of the blade 4.

For example, the plate 36 holding the blade against the base is fitted free to slide on this base in the direction of movement away from or towards the turret 2, and the latter is provided opposite the channel 18, with an area 55 where the annular groove 30 is left unengaged on the upper side, between the cylindrical periphery of the turret 2 and a chord substantially coinciding with the cutting edge 33 of the blade when the turret is in the position for the fitting of the tube to be cut 5 into the channel 18, or the ejection position, that is at a position of 180° away from the position illustrated.

It is therefore possible to leave the blade 4 quite clear and accessible on the upper side, if desired, to extract it easily; a tab 56 at the side of the base 1 makes it possible to insert the finger beneath the blade to facilitate this task.

When the plate 36 has been returned to the position illustrated, there is no difficulty in holding the blade in position as firmly as possible to prevent any deformation thereof. For this purpose, the plate 36 is firmly applied by screwing it to the base 1 and the latter, as well as the plate 36, are adapted to accommodate the cylindrical periphery of the turret 2 in the areas in cotact with the blade, in order that the latter may be secured over a maximum of its surface area.

What is claimed is:

1. Apparatus for cutting a tube of semirigid material at a pre-determined point to make possible separate removal of first and second contents of the tube on opposite sides of the cutting point, and comprising:

a flat blade provided with a cutting edge and a flat portion, the dimensions of the latter being at least equal to the cross-sectional dimensions of a tube to be cut at the desired cutting point;

jaws which together define a longitudinal channel with a transverse profile complementary to that of the tube to be cut so that they can receive the latter inside them, the said jaws also defining in an area adjacent to the channel, a slot running transversely in relation to the general direction of the channel and intersecting the latter transversely across and through the whole of its transverse periphery at a level corresponding with the level at which it is desired to cut a tube when fixed in the channel;

means for clenching the jaws around a tube so as to grip it over the greater part of its periphery, at least in zones situated in the immediate proximity of the slot and on both sides of the latter; means for relatively moving the blade and the jaws whereby the blade enters the slot and its cutting edge passes transversely through the channel to cut a tube therein until the flat part of the blade completely covers the cross-section of the channel at the point of the slot, and seals off the two parts of the tube after cutting each other and;

means for axially adjusting the position of said tube within said channel to bring the position of an interface between said first and second contents of said tube into coincidence with the position of said blade, said adjusting means comprising a stop provided in said channel between said slot and a first end thereof to abut the tubes, and means for adjusting the position of said stop in said channel.

2. Apparatus as claimed in claim 1, in which the means for relatively moving the blade and the jaws are such that the cutting edge of the blade is in a tangential position in relation to the channel, at least at the beginning of a cutting operation.

3. Apparatus as claimed in claim 2, in which the means for relatively moving the blade and the jaws are such that the cutting movement of the cutting edge is accompanied by a translatory movement of the latter tangentially in relation to the channel.

4. Apparatus as claimed in claim 1, in which the blade is fixed to a base and the means for relatively moving the blade and the jaws comprise a turret fitted with the jaws in such a position that the general plane of the slit coincides with the general plane of the blade, the said turret being freely rotatably mounted free to rotate on the base about an axis perpendicular to the general plane of the blade between a first position where the blade clears the cross-section of the channel and a second position where the flat part of the blade covers the cross-section of the channel.

5. Apparatus as claimed in claim 4, in which the means clenching the jaws around a tube are associated with the rotary movement of the turret so that the jaws are unclenched in the first position and clenched in the second position.

6. Apparatus as claimed in claim 5, in which the one of the jaws is fixed in relation to the turret, and the means associating the clenching of the jaws to the rotary movement of the turret incorporate an eccentric cam which is fixed in relation to the base, a cam-follower being fixed to the other jaw to slide over the periphery of the cam during the rotation of the turret.

7. Apparatus as claimed in claim 1, in which the jaws contact the whole surface of the tube on either side of the slot.

8. Apparatus as claimed in claim 1, further comprising means for ejecting the tube from the channel after the cutting operation.

9. Apparatus as claimed in claim 8, in which the ejection means includes means for moving said stop inside the channel towards the second end of the latter.

10. Apparatus as claimed in claim 9, in which said means for moving said stop comprises means for moving the stop towards the second end of the channel over two successive distances corresponding respectively to the length of the channel between the second end thereof and the slit, and to the length of the channel between the slit and the stop position at rest.

11. Apparatus for cutting a tube of semi-rigid material at a predetermined point to make possible separate removal of first and second contents of the tube on opposite sides of the cutting point, said apparatus comprising a base, a turret mounted on said base for rotation about an axis, said turret having an peripheral slot perpendicular to said axis and comprising two jaws movable toward and away from one another, a channel defined between said jaws near the periphery of said turret to receive said tube, said channel having a cross sectional shape corresponding to that of said tube and extending on opposite sides of said slot, said slot extending radially inwardly from the periphery of said turret to a point radially inwardly of said channel, a flat blade having a cutting edge and a flat portion, the dimensions of the latter being at least equal to the cross sectional dimensions of said tube, and means for mounting said blade in fixed position on said base perpendicular to said axis of said turret and in position to enter said slot and extend radially inwardly therein to a point radially inwardly of said channel, means for rotating said turret between a first position in which said channel is removed from the position of said blade and a second position in which said channel is intersected by said blade, means for moving said jaws apart to increase the cross-sectional size of said channel to a size slightly larger than said tube when said turret is in said first position, and for moving said jaws towards one another to grip said tube on opposite sides of said slot when said turret is in said second position, whereby a tube inserted in said channel when said turret is in said first position is cut by said blade and the cut ends of resulting sections of said tube are sealed by said flat portion of said blade, and means in said channel engaging an end of said tube to position said tube precisely in said channel to bring an interface between said first and second contents into coincidence with the position of said blade, and for ejecting cut sections of said tube after said tube has been cut and said turret has been returned from said second position to said first position.

12. Apparatus according to claim 11, in which said jaws are defined by a chord-wise extending cut in said turret parallel to and offset from said axis, and in which said means for moving said jaws apart comprises cam means on said base and a cam follower on one of said jaws engageable with said cam upon rotation of said turret.

13. Apparatus according to claim 11, in which said positioning and ejecting means comprises a movable abutment in said channel means for precisely positioning said abutment at a first position to position said tube in said channel, means for moving said abutment from said first position toward said slot a predetermined distance to a second position to eject one section of the cut tube and for moving said abutment further toward said slot to a third position to eject a second section of said tube.

* * * * *